US008369769B2

(12) United States Patent
Ohmori et al.

(10) Patent No.: US 8,369,769 B2
(45) Date of Patent: Feb. 5, 2013

(54) CLEANING BLADE, IMAGE FORMING APPARATUS, AND PROCESS CARTRIDGE

(75) Inventors: Masahiro Ohmori, Kanagawa (JP); Yohta Sakon, Kanagawa (JP); Masanobu Gondoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 157 days.

(21) Appl. No.: 13/037,754

(22) Filed: Mar. 1, 2011

(65) Prior Publication Data

US 2011/0217102 A1 Sep. 8, 2011

(30) Foreign Application Priority Data

Mar. 2, 2010 (JP) ..... 2010-045377

(51) Int. Cl.
*G03G 21/00* (2006.01)

(52) U.S. Cl. ..... 399/350

(58) Field of Classification Search ..... 399/71, 399/100, 101, 273, 283, 326, 346, 347, 350; 15/256.5

See application file for complete search history.

(56) References Cited

U.S. PATENT DOCUMENTS

| | | | | |
|---|---|---|---|---|
| 6,704,539 | B2 * | 3/2004 | Nakayama | 399/350 |
| 7,254,364 | B2 * | 8/2007 | Nakayama | 399/345 |
| 8,224,224 | B2 * | 7/2012 | Ohmori et al. | 399/350 |
| 2006/0216526 | A1 * | 9/2006 | Tomiyama et al. | 428/423.1 |
| 2012/0063826 | A1 * | 3/2012 | Ohmori et al. | 399/350 |

FOREIGN PATENT DOCUMENTS

| | | | |
|---|---|---|---|
| JP | 2001343874 | A * | 12/2001 |
| JP | 2004-233818 | | 8/2004 |
| JP | 3602898 | | 10/2004 |
| JP | 2005148403 | A * | 6/2005 |
| JP | 2005181434 | A * | 7/2005 |
| JP | 2007078987 | A * | 3/2007 |
| JP | 2009-223073 | | 10/2009 |
| JP | 2009223071 | A * | 10/2009 |
| JP | 2009300751 | A * | 12/2009 |

* cited by examiner

*Primary Examiner* — Robert Beatty

(74) *Attorney, Agent, or Firm* — Cooper & Dunham LLP

(57) ABSTRACT

A cleaning blade, including a reed-shaped elastic blade configured to move an edge of the elastic blade on the surface of a member to be cleaned while contacting the edge to the surface thereof to remove a powder therefrom, wherein surface layers harder than the elastic blade are formed on an distal face having the edge as one of its lines facing the member to be cleaned and an proximal face having the edge as one of its lines parallel in a thickness direction of the blade, respectively, and wherein a friction coefficient between the surface layer on the distal face of the blade and the member to be cleaned is lower than that between the surface layer on the proximal face of the blade and the member to be cleaned.

8 Claims, 4 Drawing Sheets

CIRCUMFERENTIAL LENGTH: C1
PARTICLE PROJECTION AREA: S

CIRCLE HAVING AN AREA S
CIRCUMFERENTIAL LENGTH: C2

CLEANING BLADE, IMAGE FORMING APPARATUS, AND PROCESS CARTRIDGE

BACKGROUND OF THE INVENTION

1. Field of the Invention

The present invention relates to a cleaning blade removing a toner remaining on a photoreceptor after a toner image is transferred onto a transfer paper or an intermediate transferer in an image forming apparatus, and to an image forming apparatus and a process cartridge using the cleaning blade.

2. Description of the Related Art

Conventionally, in an electrophotographic image forming apparatus, an unnecessary residual toner adhering to the surface of an image bearer such as photoreceptors to be cleaned after a toner image transferred onto a transfer paper or an intermediate transferer is removed by a cleaner as a cleaning means.

As a cleaning member of the cleaner, a reed-shaped cleaning blade is known because of having a simple structure and good cleanability. The cleaning blade is formed of a reed-shaped elastic body such as polyurethane rubbers. The base of the cleaning blade is supported by a supporting member and the edge thereof is pressed to the circumferential surface of an image bearer to dam and scrape a toner remaining thereon.

Further, an almost spherical polymerization toner having a small particle diameter has been used in image forming apparatuses recently to produce high quality images. The polymerization toner has higher transferability than conventional pulverization toners. However, the polymerization toner is difficult to fully remove from the surface of the image bearer, resulting in poor cleaning. This is because the spherical polymerization toner having a small particle diameter scrapes from the narrowest gap between the blade and the image bearer.

A contact pressure between the image bearer and the cleaning blade needs increasing to prevent the toner from scraping from the gap. However, when the contact pressure is increased, a friction between an image bearer 3 and a cleaning blade 62 in FIG. 8A increases, the cleaning blade 62 is drawn in a travel direction of the image bearer, and an edge 62*c* of the cleaning blade 62 turns over. The cleaning blade 62 turned over occasionally makes noises when restored to its original state, resisting turning over. Further, when the cleaning continues while the edge 62*c* of the cleaning blade 62 is turned over, a local abrasion is made a few μm from the edge 62*c* of an proximal face 62*a* of the cleaning blade 62 as shown in FIG. 8B. When the cleaning continues further, the local abrasion becomes large and finally the edge 62*c* is chipped as shown in FIG. 8C. When the edge 62*c* lacks, a toner cannot normally be removed, resulting in poor cleaning.

Japanese Patent No. 3602898 discloses a cleaning blade formed of polyurethane elastomer including a surface layer formed of a resin having a hardness of pencil hardness of from B to 6H, which contacts a photoreceptor. The surface layer having a hardness of pencil hardness of from B to 6H, which is harder than a rubber member, can decrease a friction coefficient of a contact point of the cleaning blade and increase the abrasion resistance thereof. In addition, a frictional force between the image bearer and the cleaning blade can be reduced, and which can well prevent the edge of the cleaning blade from turning over. Further, the surface layer having a hardness of pencil hardness of from B to 6H is hard and difficult to deform, and which can furthermore prevent the edge of the cleaning blade from turning over.

Japanese published unexamined application No. 2004-233818 discloses a cleaning blade, on the surface of which a hardened layer is formed by impregnating and swelling an elastic blade with a silicon-containing UV curable material, and irradiating the blade with an UV ray. The hardened layer formed of the UV curable material improves the abrasion resistance of the elastic blade and can prevent the edge of the cleaning blade from turning over.

However, the cleaning blade having a (hardened) surface layer occasionally has poor cleanability. The present inventors found that the edge needs to make a stick and slip movement such that the cleaning blade has goof cleanability. The stick and slip movement means that the edge elastically deforms in a travel direction of a photoreceptor due to friction therewith and the edge restores the original form slipping on the surface thereof at a point where the blade has a restoring force larger than the friction. Then, the edge elastically deforms again in a travel direction of a photoreceptor due to friction therewith. This reciprocating movement is the stick and slip movement. When a friction coefficient between the (hardened) surface layer and the photoreceptor is too low, the friction therebetween is so small that the edge does not make the stick and slip movement and more toners scrape through between them. When the friction coefficient between the (hardened) surface layer and the photoreceptor is high, the edge fully makes the stick and slip movement and the blade has good cleanability. However, when the friction coefficient between the (hardened) surface layer and the photoreceptor is high, an oscillation noise is made.

Because of these reasons, a need exists for a cleaning blade having good cleanability, preventing its edge from turning over and making an oscillation noise.

SUMMARY OF THE INVENTION

Accordingly, an object of the present invention is to provide a cleaning blade having good cleanability, preventing its edge from turning over and making an oscillation noise.

Another object of the present invention is to provide an image forming apparatus using the cleaning blade.

A further object of the present invention is to provide a process cartridge using the cleaning blade.

To achieve such objects, the present invention contemplates the provision of a cleaning blade, comprising a reed-shaped elastic blade configured to move an edge of the elastic blade on the surface of a member to be cleaned while contacting the edge to the surface thereof to remove a powder therefrom, wherein surface layers harder than the elastic blade are formed on an distal face having the edge as one of its lines facing the member to be cleaned and an proximal face having the edge as one of its lines parallel in a thickness direction of the blade, respectively, and wherein a friction coefficient between the surface layer on the distal face of the blade and the member to be cleaned is lower than that between the surface layer on the proximal face of the blade and the member to be cleaned.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
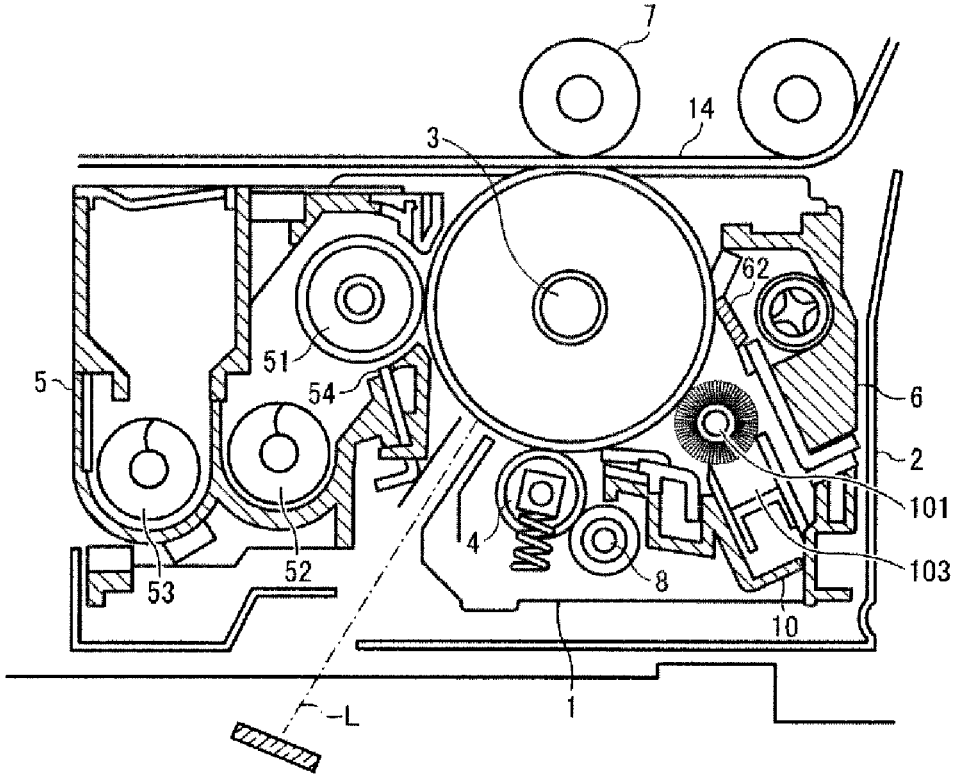
FIG. 1 is a schematic view illustrating an embodiment the printer of the present invention.

Generally, the present invention provides a cleaning blade having good cleanability, preventing its edge from turning over and making an oscillation noise. More particularly, the present invention relates to a cleaning blade, comprising a reed-shaped elastic blade configured to move an edge of the elastic blade on the surface of a member to be cleaned while contacting the edge to the surface thereof to remove a powder therefrom, wherein surface layers harder than the elastic blade are formed on an distal face having the edge as one of its lines facing the member to be cleaned and an proximal face having the edge as one of its lines parallel in a thickness direction of the blade, respectively, and wherein a friction coefficient between the surface layer on the distal face of the blade and the member to be cleaned is lower than that between the surface layer on the proximal face of the blade and the member to be cleaned.

When a friction coefficient between the surface layer of the distal face of the blade and the member to be cleaned is lower than that between the surface layer of the proximal face of the blade and the member to be cleaned, the cleanability can be improved and the oscillation noise can be prevented. The reason is not clarified, but the present inventors think as follows. Namely, when the edge is elastically deformed in a surface travel direction of the member to be cleaned due to a frictional force therewith, the surface layer of the proximal face scrapes the member to be cleaned. Then, when the friction coefficient between the surface layer of the proximal face of the blade and the member to be cleaned is low, a restoring force of the elastic blade is larger than a frictional force with the member to be cleaned at a point when the member to be cleaned contacts the surface layer of the proximal face, and the edge returns to the original form and scarcely makes stick and slip movement. When the friction coefficient between the surface layer of the proximal face of the blade and the member to be cleaned is high, the edge returns to the original form after traveling in a surface travel direction of the member to be cleaned to some extent due to a frictional force between the surface layer of the proximal face and the member to be cleaned, and fully makes stick and slip movement. Consequently, the cleanability is thought improved.

When the surface layer of the distal face of the blade contacts the member to be cleaned after used for long periods, the surface layer of the distal face of the blade scarcely deforms elastically in a surface travel direction of the member to be cleaned as the edge does. Therefore, when a friction coefficient between the surface layer of the distal face of the blade and the member to be cleaned is same as a friction coefficient between the surface layer of the proximal face of the blade and the member to be cleaned, the surface layer of the distal face of the blade slightly oscillates due to a frictional force between the surface layer of the distal face of the blade and the member to be cleaned. When the slight oscillation has an audible frequency, it is thought to be a noise. When the friction coefficient between the surface layer of the distal face of the blade and the member to be cleaned is lower than the friction coefficient between the surface layer of the proximal face of the blade and the member to be cleaned, the frictional force between the surface layer of the distal face of the blade and the member to be cleaned is lowered to be smaller than a force deforming the surface layer of the distal face of the blade, which can prevent the surface layer from slightly oscillating. This is thought to be a reason why a noise is not made.

FIG. 1 is a schematic view illustrating an embodiment the printer of the present invention. The printer forms a monochrome image based on image data read by an unillustrated image reader.

As FIG. 1 shows, the printer includes a drum-shaped photoreceptor 3 as an image bearer, and which may have the shape of a sheet or an endless belt.

A charger 4, an image developer 5 developing a latent image to form a toner image, a transferer 7 transferring the toner image onto a transfer paper as a recording medium, a cleaner 6 cleaning a toner remaining on the photoreceptor 3 after transferred, a lubricator 10 applying a lubricant onto the photoreceptor 3, a discharge lamp discharging the photoreceptor 3, etc. are located around the photoreceptor 3.

The charger 4 is located not contacting the photoreceptor 3 with a predetermined gap therebetween to charge the photoreceptor 3 to have a predetermined polarity and a predetermined potential. The photoreceptor 3 uniformly charged by the charger 4 is irradiated by an unillustrated irradiator as a latent image former with light L based on image data.

The image developer 5 has a developing roller 51 as a developer bearer. The developing roller 51 is applied with a developing bias from an unillustrated electric power source. In a casing of the image developer 5, a feed screw 52 and a stirring screw 53 stirring a developer contained in the casing while transferring the developer in reverse directions each other are located. Further, a doctor 53 regulating the developer borne by the developing roller 51 is located. A toner in the developer stirred and transferred by the two screws, i.e., the feed screw 52 and the stirring screw 53 is charged to have a predetermined polarity. The developer is scooped by the developing roller 51 and regulated by the doctor 54, and the toner adheres to the latent image on the photoreceptor 3 at a developing area facing the photoreceptor 3. The cleaner 6 has a cleaning blade 62 contacting the photoreceptor 3 in a surface travel direction thereof. The details of the cleaning blade 62 will be explained later in detail.

The lubricator 10 includes a solid lubricant 103, an illustrated lubricant pressure spring, and a fur brush 101 as an application brush applying the solid lubricant 103 onto the photoreceptor 3. The solid lubricant 103 is held by an unillustrated bracket and pressed by the lubricant pressure spring against the fur brush 101. The solid lubricant 103 is scraped by the fur brush 101 driven to rotate by the rotation of the photoreceptor 3, and applied onto the photoreceptor 3. The surface of the photoreceptor keeps having a friction coefficient not greater than 0.2 with the application of the lubricant thereto.

Known chargers such as corotrons, scorotrons and solid state chargers can be used as the charger 4. The chargers preferably contacts or are located close to a photoreceptor because of having high charge efficiency, generating less ozone, and being downsizable.

Specific examples of the light sources for the unillustrated irradiator and discharge lamps include fluorescent lamps, tungsten lamps, halogen lamps, mercury lamps, light emitting diodes (LEDs), laser diodes (LDs), electroluminescence (EL) devices, etc. In order to irradiate the photoreceptor with a light beam having a wavelength in a desired wavelength range, filters such as sharp cut filters, band pass filters, near infrared cut filters, dichroic filters, interference filters, color conversion filters, etc., can be used.

The light emitting diodes (LEDs) and the laser diodes (LDs) are preferably used because of having a high irradiation energy and a long light wavelength of from 600 to 800 nm.

Next, an image forming operation in the printer will be explained.

When the printer receives a signal executing printing from an unillustrated operating part, a predetermined voltage or a current is applied to each of the charger 4 and the developing roller 51 at a predetermined time. Similarly, a predetermined voltage or a current is applied to each of the irradiator and the discharge lamp at a predetermined time. In synchronization with this, the photoreceptor 3 is driven to rotate in an arrow direction by an unillustrated drive motor.

When the photoreceptor 3 rotates in the arrow direction, the surface thereof is charged by the charger 4 to have a predetermined potential. Then, light L corresponding to an image signal is irradiated from the irradiator onto the photoreceptor 3 such that a part thereof irradiated with light L is discharged and an electrostatic latent image is formed thereon.

The surface of the photoreceptor 3 an electrostatic latent image is formed on is scraped by a magnetic brush of a developer formed on the developing roller 51 at a part facing the image developer 5. Then, a negatively-charged toner on the developing roller 51 transfers to the electrostatic latent image by a predetermined developing bias applied thereto such that the electrostatic latent image is developed to be a toner image. In this embodiment, an electrostatic latent image formed on the photoreceptor 3 is reversely developed with a negatively-charged toner by the image developer 5. The present invention is not limited to this embodiment where a negative/positive (toner adheres to a place having lower potential) noncontact charging roller method is used.

The toner image formed on the photoreceptor 3 is transferred onto a transfer paper fed from an unillustrated paper feeder passing between an upper registration roller and a lower registration roller into a transfer area formed between the photoreceptor 3 and the transferer 7. Then, the transfer paper is fed in synchronization with the end of an image between the upper registration roller and the lower registration roller. A predetermined transfer bias is applied when the toner is transferred onto the transfer paper. The transfer paper the toner image is transferred onto is separated from the photoreceptor 3 and fed to an unillustrated fixer. While passing the fixer, the toner image is fixed on the transfer paper with heat and pressure, and discharged out of the printer.

Meanwhile, a residual toner after transferred on the surface of the photoreceptor 3 is removed by the cleaner 6. The surface thereof is discharged after applied with a lubricant by the lubricator 10.

In the printer, the photoreceptor 3, the charger 4, the image developer 5, the cleaner 6, the lubricator 10, etc. are included in a chassis 2 as a process cartridge 1, and which is detachable from the printer. The process cartridge 1 is exchangeable as a unit, and its components, i.e., the photoreceptor 3, the charger 4, the image developer 5, the cleaner 6, the lubricator 10, etc. are individually exchangeable also.

Next, a preferred toner for the printer will be explained.

Highly-spherable and downsizable polymerization toners prepared by suspension polymerization methods, emulsion polymerization methods and dispersion polymerization methods are preferably used for the printer to produce images having improved quality. Particularly, the polymerization toner preferably has a circularity not less than 0.97 and a volume-average particle diameter not greater than 5.5 μm to produce images having high-resolution.

Figure 2A:
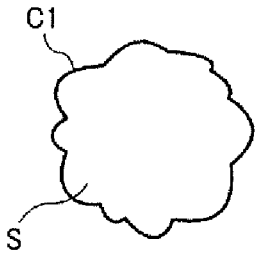
FIGS. 2A and 2B are explanatory drawings of explaining a method of measuring a circularity of a toner.
Figure 2B:
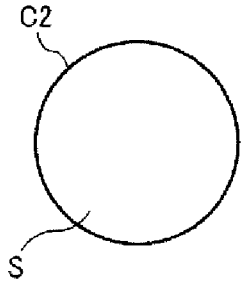

The circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer. Based on the measured result, an average of C2/C1 is determined as a circularity, when C1 is an outer circumferential length of the actual toner projected shape in FIG. 2A, and C2 is an outer circumferential length of a true circle having the same area as a projected area S of the actual toner projected shape in FIG. 2B.

The volume-average particle diameter can be measured by a Coulter Multisizer 2e from Beckman Coulter, Inc. as follows:

0.1 to 5 ml of a surfactant, preferably alkylbenzene sulfonate salt was included as a dispersant in 100 to 150 ml of an electrolyte including primary sodium chloride in an amount of 1% by weight;

2 to 20 mg of a sample were included in the electrolyte and dispersed by an ultrasonic disperser for about 1 to 3 min to prepare a sample dispersion liquid; and Placing 100 to 200 ml of the electrolyte in another beaker and adding the sample dispersion liquid to measure the volume-average particle diameter by the Coulter Multisizer 2e using an aperture of 100 μm, 50,000 toner particles and the following 13 channels:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

In the present invention, an interface producing a number distribution and a volume distribution from Nikkaki Bios Co., Ltd. and a personal computer are connected with the Coulter Multisizer 2e to measure the volume-average particle diameter.

The volume-average particle diameter is determined by the following formula:

$$\Sigma XfV/\Sigma fV$$

wherein X is a representative diameter of each channel, V is an equivalent volume of the representative diameter of each channel, and f is the number of particles of each channel.

The polymerization toner cannot be fully removed by the cleaning blade 62 as the pulverization toner cannot from the photoreceptor 3, resulting in poor cleaning. When the contact pressure of the cleaning blade 62 against the photoreceptor 3 is increased to improve cleanability of the cleaning blade 62, the cleaning blade 62 is abraded earlier. Further, when a friction between the cleaning blade 62 and the photoreceptor 3 increases, the cleaning blade 62 is drawn in a travel direction of the image bearer, and an edge contacting the photoreceptor 3 of the cleaning blade 62 is drawn in a travel direction of the photoreceptor 3 turn over. When the edge of the cleaning blade 62 turns over, various problems such as noises, vibrations and chipping occur. In this embodiment, the edge of the cleaning blade 62 is impregnated with a member selected from the group consisting of isocyanate compounds, fluorine-containing compounds and silicone compounds to decrease abrasion and increase hardness of the edge. Further, a surface layer harder than the cleaning blade 62 is formed on each of an distal face and an proximal face of the blade.

Figure 3:
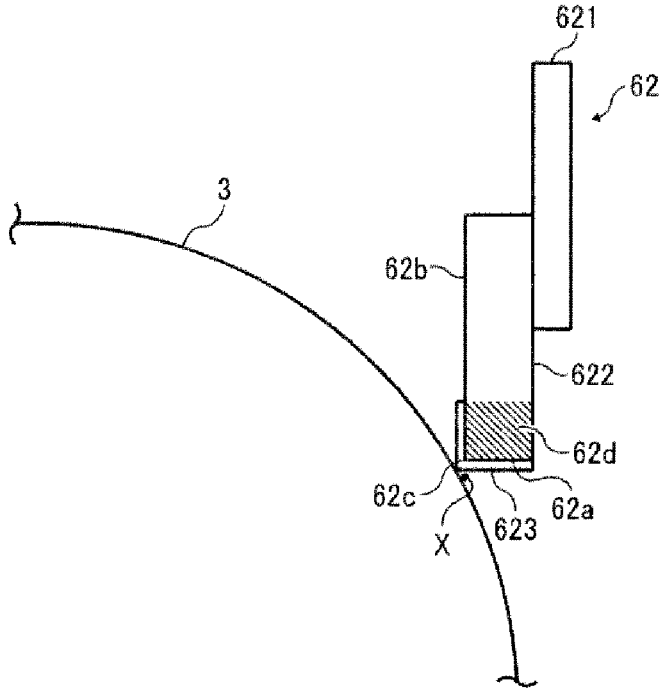
FIG. 3 is a perspective view illustrating an embodiment the of the cleaning blade of the present invention.
Figure 4:
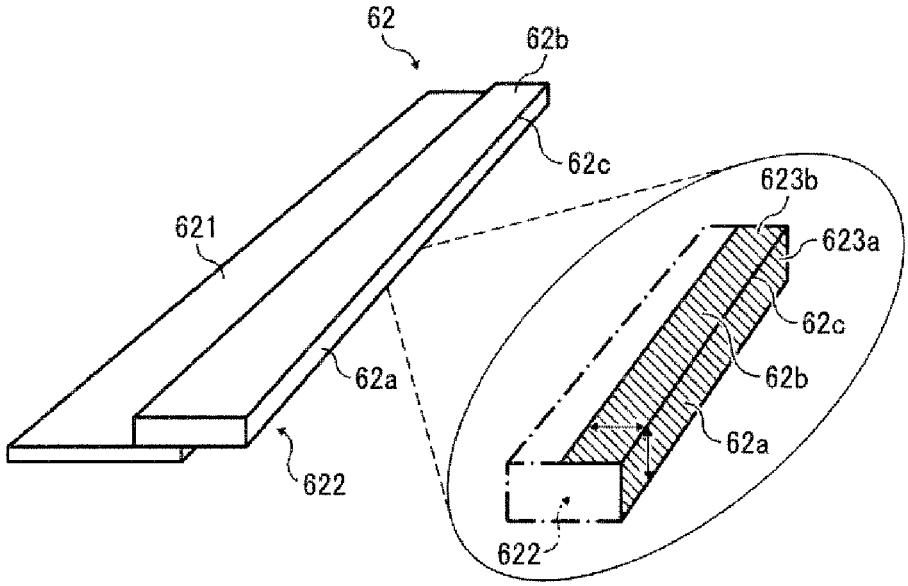
FIG. 4 is an enlarge sectional view illustrating the embodiment the of the cleaning blade of the present invention in FIG. 3.

FIG. 3 is a perspective view illustrating the cleaning blade 62, and FIG. 4 is an enlarge sectional view illustrating the cleaning blade 62. The cleaning blade 62 is constituted of a reed-shaped holder 621 formed of a stiff material such as metals and hard plastics and a reed-shaped elastic blade 622. An edge 62*c* of the elastic blade 622 is subjected to an impregnation treatment.

The elastic blade 622 is fixed with an adhesive on an end of the holder 621, and the other end thereof is cantileverly supported by a case of the cleaner 6.

The elastic blade 622 preferably has high repulsive elasticity so as to follow eccentricity or slight surface undulation of the photoreceptor 3, and is preferably formed of a urethane rubber which is a rubber including a urethane group.

The urethane rubber of the elastic blade 622 preferably has a hardness of from 70 to 75° (JIS A) at 25° C. When greater than 75°, the elastic blade has less flexibility. For example, when fixed on the holder 621 at a slight tilt, the cleaning blade 62 is difficult to have an even contact pressure in its axial direction, i.e., likely to have different contact pressures at an end and the other end in its axial direction, resulting in poor cleanability. When less than 70°, the cleaning blade 62 warps when having high contact pressure to remove even a polymerization toner. The edge 62*c* of the cleaning blade 62 floats above, and an distal face 62*b* of the cleaning blade 62 contacts the photoreceptor 3. When the distal face of the cleaning blade contacts the photoreceptor, a contact area between the cleaning blade 62 and the surface of the photoreceptor rapidly expands. Therefore, the contact pressure becomes rather small even when the cleaning blade 62 is pressed with a large force, resulting in deterioration of cleanability.

The hardness of the elastic blade 622 changes when the urethane rubber is modified by the impregnation treatment, and is influenced by formation of surface layers 623*a* and 623*b*. Therefore, their effects need controlling.

The edge 62*c* of the elastic blade 622 can be subjected to an impregnation treatment when impregnated by spray coatings, dip coatings, etc. with a member selected from the group consisting of isocyanate compounds, fluorine-containing compounds and silicone compounds. This causes the edge 62*c* to have a low friction coefficient and high hardness inside. The edge 62*c* preferably has a friction coefficient not greater than 0.5.

Further, when the edge of the elastic blade 622 is exposed after the surface layer is abraded, a frictional force between the edge of the elastic blade 622 and the photoreceptor 3 contacting each other can be reduced to prevent the contact point from deforming in a surface travel direction of the photoreceptor.

The surface layers 623*a* and 623*b* are formed on an distal face and an proximal face of the elastic blade 622, respectively by spray coatings, dip coatings or screen printings. The surface layers 623*a* and 623*b* are preferably coated with a member having a higher hardness than the elastic blade 622. Therefore, the surface layers 623*a* and 623*b* are rigid and difficult to deform, which can prevent the edge 62*c* of the cleaning blade 62 from turning over.

The surface layers 623*a* and 623*b* are preferably made of a resin, and more preferably a UV curing resin. Desired surface layers 623*a* and 623*b* can be formed only by irradiating a resin adhering to the proximal face 62*a* and the distal face 62*b* of the elastic blade 622 with UV light, which can produce the cleaning blade 62 at low cost.

Figure 8A:
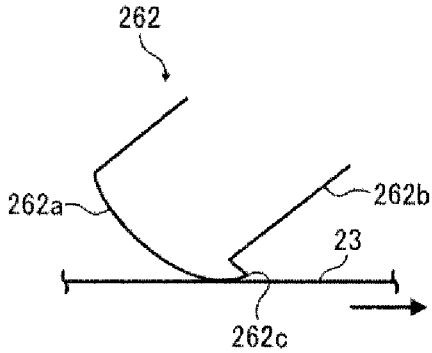
FIG. 8A is a schematic view illustrating the turned over edge of the cleaning blade, 8B is a schematic view for explaining a local abrasion of an proximal face of the cleaning blade, and 8C is a schematic view illustrating the chipped edge of the cleaning blade.
Figure 8B:
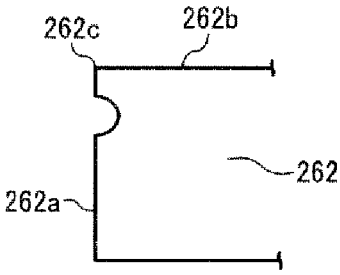
Figure 8C:
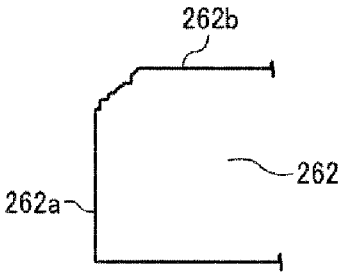

The UV curing resin preferably includes a monomer having a molecular weight of from 200 to 1,500 at one three-dimensional crosslinking point. When greater than 1,500, the surface layers 623*a* and 623*b* are so fragile that the edge 62*c* of the cleaning blade 62 and the proximal face thereof is abraded as FIG. 8B shows, resulting in inability to maintain cleanability for long periods. When less than 300, the surface layers 623*a* and 623*b* are so rigid that their abrasion resistances deteriorate and are likely to make noises.

The surface layers 623*a* and 623*b* preferably have a thickness of from 1 to 10 μm. When less than 1 μm, their rigidities deteriorate and the edge 62*c* of the cleaning blade 62 is likely to turn over. When greater than 10 μm, they prevent the edge 62*c* from elastically deforming and the cleaning blade 62 from uniformly contacting the photoreceptor. Therefore, toners scrape through more, resulting in poor cleaning and noise generation.

Further, when the surface layer 623*a* on the proximal face of the blade has thickness greater than 10 μm, toners scrape through more, resulting in poor cleaning. The surface layer 623*a* is formed on the proximal face of the blade with a liquid material adhering thereto by spray coatings or dip coatings. The edge 62*c* is difficult to coat due to a surface tension. The thickness of the surface layer 623*a* increases with distance from the edge 62*c*. When the thickness is greater than 10 μm, a difference between the layer thickness of the edge 62*c* and that of a position distant therefrom is large. The edge 62*c* of the cleaning blade 62 has a blunt angle. When the edge 62*c* has a blunt angle, an upstream space X (FIG. 3) of a contact point between the proximal face 62*a* and the photoreceptor 3 narrows more than when the edge 62*c* has a right angle. Therefore, when a toner accumulates in the space after cleanings for long periods, the toner in the space X is gradually extruded to the downstream side of the photoreceptor 3 because of having no way out, resulting in poor cleaning.

A friction coefficient between the surface layer 623*a* on the proximal face and the photoreceptor is preferably from 0.3 to 0.6. The edge 62*c* elastically deforms in a travel direction of the photoreceptor 3 due to friction therewith. When the edge 62*c* elastically deforms in a travel direction of the photoreceptor, the surface layer 623*a* on the proximal face contact the photoreceptor 3. Then, since the friction coefficient between the surface layer 623*a* on the proximal face and the photoreceptor is from 0.3 to 0.6, a frictional force therebetween is larger than a restoring force of the edge 62*c*. Therefore, the edge 62*c* elastically deforms more in a travel direction of the photoreceptor. When the edge 62*c* elastically deforms so as not to turn over, the restoring force of the edge 62*c* is larger than the frictional force between the surface layer 623*a* on the proximal face and the photoreceptor 3, and the edge 62*c* returns to have the original shape. Such a reciprocation (stick and slip movement) as the edge 62*c* returns to have the original shape after traveling in the travel direction of the photoreceptor 3 therewith to some extent is fully performed. Therefore, the cleaning blade has good toner cleanability. Further, the abrasion of the edge 62*c* can be prevented.

When the friction coefficient between the surface layer 623*a* on the proximal face and the photoreceptor is less than 0.3, the stick and slip movement of the edge 62*c* is not fully performed and a toner scrapes through, resulting in poor cleaning. Further, the edge 62*c* scrapes the photoreceptor 3 more, resulting in quicker abrasion of the edge 62*c*. When the friction coefficient between the surface layer 623*a* on the proximal face and the photoreceptor is greater than 0.6, a frictional force therebetween increases and the edge 62*c* possibly turns over.

A friction coefficient between the surface layer 623*b* on the distal face of the blade and the photoreceptor is preferably not greater than 0.25 which is lower than the friction coefficient between the surface layer 623*a* on the proximal face and the photoreceptor. When the friction coefficient between the surface layer 623*b* on the distal face of the blade and the photoreceptor is greater than 0.25, the surface layer 623*b* on the distal face of the blade oscillates to make an oscillation noise. When the friction coefficient between the surface layer 623*b* on the distal face of the blade and the photoreceptor is not greater than 0.25, a frictional force therebetween is smaller than a force deforming the surface layer 623*b* on the distal face of the blade to prevent the surface layer 623*b* on the distal face from oscillating and making an oscillation noise.

Even after the edge of the elastic blade 622 is exposed due to abrasion of the surface layer 623*a* on the proximal face, the edge of the elastic blade 622 preferably has a friction coefficient not less than 0.25 which is higher than that of the surface layer 623*b* on the distal face of the blade so that the edge 62*c* properly performs stick and slip movement. Therefore, even after the edge of the elastic blade 622 is exposed due to abrasion of the surface layer 623*a* on the proximal face, the edge properly performs stick and slip movement and good cleanability can be maintained.

Figure 5:
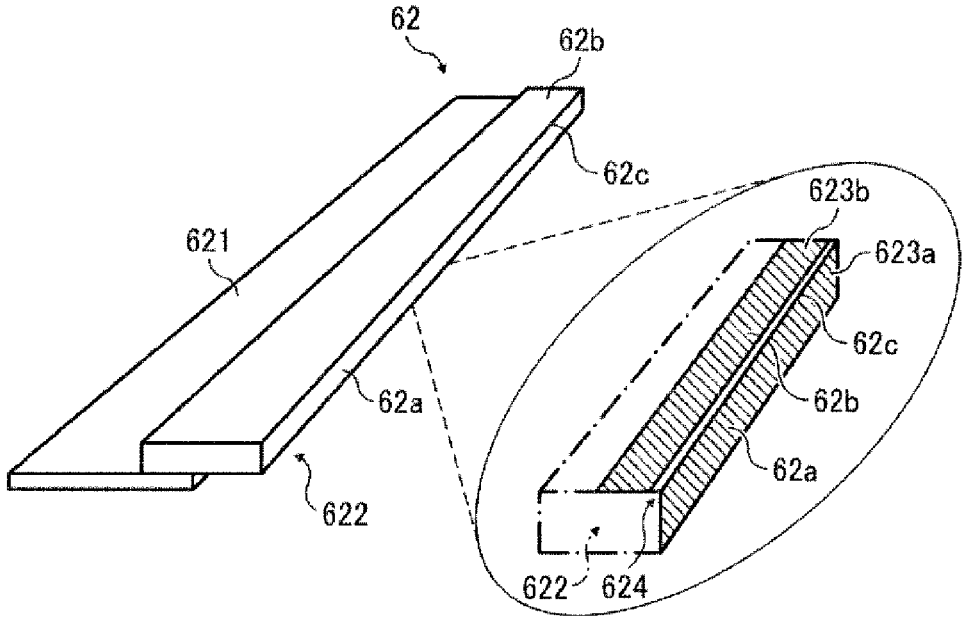
FIG. 5 is a perspective view illustrating a cleaning blade having a surface layer on an distal face thereof 20 to 50 μm apart from an edge thereof.

The surface layer 623*b* on the distal face of the blade may be formed with a predetermined distance from the edge 62*c*, and an agenetic area 624 having a width of the distal face 62*b* may be formed as FIG. 5 shows. When the edge 62*c* of the elastic blade 622 is impregnated to have higher hardness, the edge 62*c* is possibly difficult to deform. Therefore, when the surface layer 623*b* harder than the elastic blade 622 is formed on the whole distal face 62*b* of the elastic blade 622, the surface layer 623*b* disturbs the elastic deformation of the edge 62*c* of the elastic blade 622 at the surface of the photoreceptor. The edge 62*c* scarcely has a restoring force against the elastic deformation increasing a contact pressure thereof to the surface of the photoreceptor. Consequently, the edge 62*c* cannot follow eccentricity or slight surface undulation of the photoreceptor 3. The contact pressure of the edge 62*c* to the photoreceptor 3 varies and decreases when receiving a large pressure from a dammed toner after solid images are continuously produced, and the toner scrapes through the cleaning blade 62, resulting in possible poor cleaning. Therefore, it can be thought that the surface layer 623*b* is not formed on the distal face 62*b* of the elastic blade 622. When the surface layer 623*b* is not formed on the distal face 62*b*, the edge 62*c* of the elastic blade 622 elastically deforms largely in the surface travel direction of the photoreceptor and turns over, resulting in possible abrasion thereby.

Figure 6:
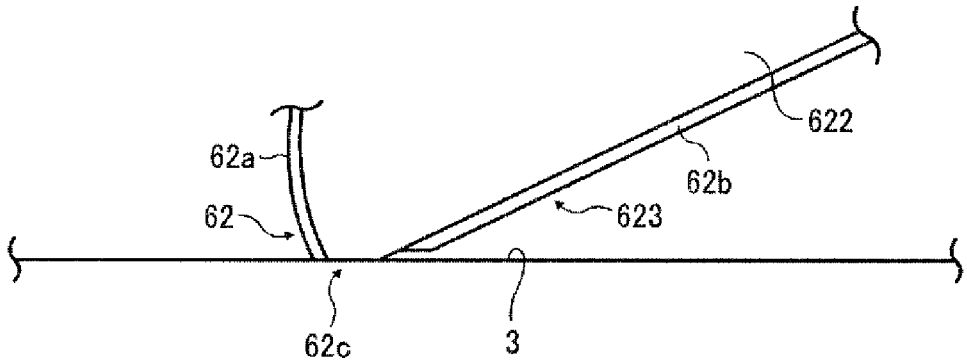
FIG. 6 is a schematic view for explaining a contact state of the edge of the cleaning blade having a surface layer on an distal face thereof 20 to 50 μm apart therefrom.
Figure 7:
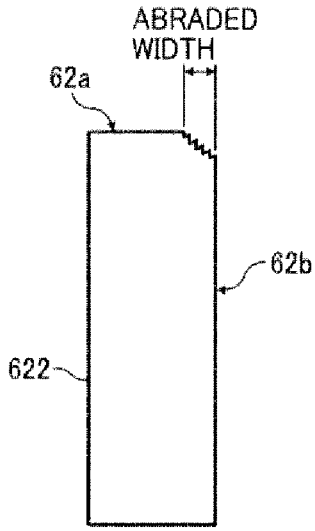
FIG. 7 is a schematic view illustrating a measured point of an abraded width of an elastic blade of the present invention.

When the agenetic area 624 having a predetermined width on the distal face 62*b* of the blade from the edge 62*c*, disturbance of the elastic deformation thereof is more prevented than when the surface layer 623*b* is formed on the whole distal face. As FIG. 6 shows, the edge 62*c* of the elastic blade 622 can elastically deform in the surface travel direction of the photoreceptor so as not to turn over. Therefore, even when the photoreceptor 3 has an eccentricity, the restoring force of the edge 62*c* of the elastic blade 622 against the elastic deformation can have the edge 62*c* follow on the surface of the photoreceptor 3 to maintain good cleanability. The surface layer formed on the distal face 62*b* of the elastic blade 622 in a longitudinal direction thereof from the edge across the agenetic area 624 can prevent the edge 62*c* of the elastic blade 622 from elastically deforming largely in the surface travel direction of the photoreceptor and turning over.

The agenetic area 624 preferably has a width of from 20 to 50 μm. When less than 20 μm, the effect is not enough. When greater than 50 μm, the effect of the surface layer 623*b* is not enough and the edge 62*c* possibly turns over.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The material of the elastic blade 622, the method of impregnating, and the materials of the surface layers 623*a* and 623*b* were changed to perform durability tests.

[Elastic Blade]

Three urethane rubbers having the following properties at 25° C. were prepared for the elastic blade 622:

urethane rubber 1 having a hardness of 72° and a repulsive elasticity 31% from TOYO TIRE & RUBBER CO., LTD.;

urethane rubber 2 having a hardness of 69° and a repulsive elasticity 50% from TOYO TIRE & RUBBER CO., LTD.; and urethane rubber 3 having a hardness of 74° and a repulsive elasticity 49% from TOYO TIRE & RUBBER CO., LTD.

The hardness of the urethane rubber was measured by a durometer from Shimadzu Corp. according to JIS K6253. Three pieces of 2 mm thick sheet of the urethane rubber were overlaid each other to have a thickness not less than 6 mm as a sample.

The repulsive elasticity of the urethane rubber was measured by a resilience tester No. 221 from Toyo Seiki Seisakusho, LTD. according to JIS K6255. Two pieces of 2 mm thick sheet of the urethane rubber were overlaid each other to have a thickness not less than 4 mm as a sample.

| [Impregnating Agent] | |
|---|---|
| (Impregnating Agent 1) | |
| Isocyanate compound<br>MDI from KANTO CHEMICAL CO., INC. | 10 |
| 2-butanone | 90 |
| (Impregnating Agent 2) | |
| Isocyanate compound<br>MR-100 from NIPPON POLYURETHANE INDUSTRY CO., LTD. | 10 |
| Silicone resin<br>MODIPER F600 from NOF CORPORATION | 5 |
| 2-butanone | 85 |

| [Surface Layer] | |
|---|---|
| (Surface Layer 1 having a friction coefficient of 0.25) | |
| Urethane acrylate oligomer<br>UN-904 from Negami Chemical Industrial Co., Ltd. | 10 |
| Acrylate oligomer having a low friction coefficient<br>V-3F from Osaka Chemical Industry Co., Ltd. | 1 |

-continued

| [Surface Layer] | |
|---|---|
| Polymerization initiator<br>IRGACURE 184 from Ciba Speciality Chemicals | 1 |
| 2-butanone | 88 |
| (Surface Layer 2 having a friction coefficient of 0.30) | |
| Acrylate oligomer<br>PETIA from DAICEL-CYTEC Company LTD. | 10 |
| Polymerization initiator<br>IRGACURE 184 from Ciba Speciality Chemicals | 1 |
| 2-butanone | 89 |
| (Surface Layer 3 having a friction coefficient of 0.6) | |
| Acrylate oligomer<br>UN-2700 from Negami Chemical Industrial Co., Ltd. | 10 |
| Polymerization initiator<br>IRGACURE 184 from Ciba Speciality Chemicals | 1 |
| 2-butanone | 89 |

A maximum static friction coefficient between the surface layer and the photoreceptor was measured by TRIBOGEAR MUSE 94i from SHINTO Scientific Co., Ltd. as the friction coefficient. A coating material was coated by spraying on a glass plate of 50 mm×50 mm to have a thickness about 10 μm. A film made of the same materials as those in the surface of the photoreceptor was used as a slider.

Urethane acrylate UN-904 from Negami Chemical Industrial Co., Ltd. itself (100%) has a Martens hardness about 300 N/mm$^2$. Urethane rubber having a hardness of 70° has a Martens hardness of 1 N/mm$^2$ or less, and the surface layers 1 to 3 including urethane acrylate oligomer as a main component have hardness fully higher than those of the elastic blade 1 to 3.

Either of the urethane rubbers 1 to 3 was used to prepare a reed-shaped elastic blade having a thickness of 1.8 mm. The elastic blade was dipped in one of the impregnating agents 1 and 2 for a predetermined time and dried for 3 min. Further, either of the surface layers 1 to 3 was formed by spray coating methods and screen printing methods on the proximal face and the distal face of the blade. Specifically, the whole proximal face of the impregnated elastic blade made of the urethane rubber was coated by a spray gun at 10 mm/s to have a predetermined layer thickness. After the blade was dried for 3 min, a surface layer was formed by screen printing on an distal face of the blade across a predetermined agenetic area from an edge of the blade having a width about 3 mm at an end. Silk screen 230 mesh from Taiyo Seiki Co., Ltd. was used for the screen printing. A predetermined pattern regulating the agenetic area is formed by UV irradiation, the surface layer material was coated after the viscosity thereof was controlled. Then, the blade was further dried for 3 min and UV light was irradiated thereto (140 W/cm×5 m/min×5 passes).

The elastic blade the surface layers are formed on its apical and distal faces is fixed on a metal plate holder installable in multifunctional full-color copier MP C4500 from Ricoh Company, Ltd. with an adhesive. This was installed therein having the same configuration as that in FIG. 1 to prepare image forming apparatuses in Examples 1 to 5 and Comparative Example 1 to 3. The cleaning blade was installed so as to have a linear pressure of 20 g/cm and a cleaning angle of 79°. The apparatus has a lubricator 10 applying a lubricant to the surface of the photoreceptor to maintain a static friction coefficient thereof not greater than 0.2 when not forming images. The static friction coefficient of the surface of the photoreceptor was measured by oiler belt method disclosed in Japanese published unexamined application No. 9-166919.

A polymerization toner having the following properties was used in the present invention.

| | |
|---|---|
| Mother toner<br>having a circularity of 0.98 and<br>an average diameter of 4.9 μm. | 93 |
| Small-sized silica<br>H2000 from Clariant (Japan) K.K. | 1.5 |
| Small-sized titanium oxide<br>MT-150AI from Tayca Corp. | 0.5 |
| Large-sized silica<br>UFP-30H from DENKI KAGAKU KOGYO KABUSHIKI KAISHA | 1.0 |

50,000 A4 images having an image area of 5% at 3 prints/job were produced at 21° C. and 65% Rh. The following subjects were evaluated.

Poor cleaning: Visual observation

Evaluated image: 20 A4 images of three vertical zone pattern having a width of 43 mm in the paper travel direction Blade edge abrasion width: Abrasion width seen from the distal face of the blade The cleaning blades of Examples 1 to 5 and Comparative Examples 1 to 3 were evaluated as follows. The thickness of the surface layer was measured by a microscope VHX-100 from Keyence Corp. A trimming razor for preparing SEM sample from Nisshin EM Corp was used to cut a cross section.

The friction coefficient of the edge of the cleaning blade was measured by a friction and abrasion tester with a blade holder from Shinto Scientific Co., Ltd. Specifically, the cleaning blade was contacted to a pseudo-photoreceptor which is a glass plate a film including the same component of the surface layer at a linear pressure of 20 g/cm and a angle of 79°, and the glass plate was moved and the dynamic friction coefficient was measured.

Example 1

Base urethane rubber: Urethane rubber 1
Impregnating agent: Impregnating agent 1
Impregnating time: 30 sec
Proximal face layer: Surface layer 2
Distal face layer: Surface layer 1
Surface layer thickness 50 μm from the edge:
Distal face: 1 μm
Proximal face: 1 μm
Blade edge abraded width: 5 μm
Poor cleaning: None
Noise: None Example 2

Base urethane rubber: Urethane rubber 2
Impregnating agent: Impregnating agent 2
Impregnating time: 30 sec
Proximal face layer: Surface layer 3
Distal face layer: Surface layer 1
Surface layer thickness 50 μm from the edge:
Distal face: 1 μm
Proximal face: 1 μm
Blade edge abraded width: 5 μm
Poor cleaning: None
Noise: None Example 3

Base urethane rubber: Urethane rubber 3
Impregnating agent: Impregnating agent 1

Impregnating time: 30 sec
Proximal face layer: Surface layer 2
Distal face layer: Surface layer 1
Surface layer thickness 50 μm from the edge:
Distal face: 5 μm
Proximal face: 2 μm
Blade edge abraded width: 5 μm
Poor cleaning: None
Noise: None Example 4

Base urethane rubber: Urethane rubber 2
Impregnating agent: Impregnating agent 1
Impregnating time: 30 sec
Proximal face layer: Surface layer 3
Distal face layer: Surface layer 1
Surface layer thickness 50 μm from the edge:
Distal face: 3 μm
Proximal face: 2 μm
Blade edge abraded width: 5 μm
Poor cleaning: None
Noise: None Comparative Example 1

Base urethane rubber: Urethane rubber 1
Impregnation: None
Surface layer: None
Blade edge abraded width: 30 μm
Poor cleaning: 3 zonal poor cleanings
Noise: None
Proximal face was turned over and abraded Comparative Example 2

Base urethane rubber: Urethane rubber 1
Impregnation: None
Proximal face layer: Surface layer 2
Distal face layer: Surface layer 1
Surface layer thickness 50 μm from the edge:
Distal face: 3 μm
Proximal face: 2 μm
Blade edge abraded width: 20 μm
Poor cleaning: 3 zonal poor cleanings
Noise: Oscillation noise Comparative Example 3

Base urethane rubber: Urethane rubber 1
Impregnating agent: Impregnating agent 1
Proximal face layer: Surface layer 1
Distal face layer: Surface layer 3
Surface layer thickness 50 μm from the edge:
Distal face: 5 μm
Proximal face: 1 μm
Blade edge abraded width: 70 μm
Poor cleaning: 4 zonal poor cleanings
Noise: Oscillation noise
Proximal face was turned over and abraded

TABLE 1-1

| | Base Urethane | Impregnating Agent | Proximal face Layer | Distal face Layer | Base Rubber Friction Coefficient |
|---|---|---|---|---|---|
| Example 1 | 1 | 1 | 2 | 1 | 0.7 |
| Example 2 | 2 | 2 | 3 | 1 | 0.95 |
| Example 3 | 3 | 1 | 1 | 1 | 0.85 |
| Example 4 | 2 | 1 | 3 | 1 | 0.95 |
| Comparative Example 1 | 1 | — | — | — | 0.7 |
| Comparative Example 2 | 1 | — | 2 | 1 | 0.7 |
| Comparative Example 3 | 1 | 1 | 1 | 3 | 0.7 |

TABLE 1-2

| | Impregnated Part Friction Coefficient | Proximal face Layer Friction Coefficient | Distal face Layer Friction Coefficient | Proximal face Layer Thickness | Distal face Layer Thickness |
|---|---|---|---|---|---|
| Example 1 | 0.28 | 0.3 | 0.25 | 1 | 1 |
| Example 2 | 0.33 | 0.6 | 0.25 | 1 | 1 |
| Example 3 | 0.27 | 0.3 | 0.25 | 5 | 2 |
| Example 4 | 0.4 | 0.6 | 0.25 | 3 | 2 |
| Comparative Example 1 | — | — | — | — | — |
| Comparative Example 2 | — | 0.3 | 0.25 | 3 | 2 |
| Comparative Example 3 | 0.28 | 0.25 | 0.6 | 5 | 1 |

TABLE 1-3

| | Abraded Width | Poor Cleaning | Noise | Remarks |
|---|---|---|---|---|
| Example 1 | 5 | None | None | |
| Example 2 | 5 | None | None | |
| Example 3 | 5 | None | None | |
| Example 4 | 5 | None | None | |
| Comparative Example 1 | 30 | 3 zonal poor cleanings | None | Proximal face was turned over and abraded |
| Comparative Example 2 | 20 | 3 zonal poor cleanings | Oscillation Noise | |
| Comparative Example 3 | 70 | 4 zonal poor cleanings | Oscillation Noise | Proximal face was turned over and abraded |

Tables 1-1 to 1-3 are evaluation results of the cleaning blades prepared in Examples 1 to 4 and Comparative Example 1 to 3.

All of the cleaning blades prepared in Examples 1 to 4 could maintain good cleanability and prevent noises.

The edges 62C were impregnated to have low friction coefficient and high hardness in Examples 1 to 4. The lubricator 10 applying a lubricant to the surface of the photoreceptor maintains a static friction coefficient thereof not greater than 0.2 when not forming images. The friction coefficient between the surface layer on the distal face of the blade and the photoreceptor is not greater than 0.25 to avoid making noises. The frictional force between the photoreceptor 3 and the edges 62C can be reduced to prevent the edges 62C from turning over and the elastic blade 622 from being abraded. The surface layer 623*b* on the distal face of the blade and the surface layer 623*a* on the proximal face of thereof reinforce the neighborhood of the edge of the elastic blade 622 to properly prevent the edge from moving and turning over. The abraded width was not greater than 5 μm after 50,000 images were produced. This is because the friction coefficient between the surface layer 623*a* on the proximal face and the photoreceptor is from 0.3 to 0.6, and the edge 62C properly makes a stick and slip movement to prevent the abrasion. Even after the neighborhood of the edge on the proximal face of the elastic blade 622 is exposed as the surface layer 623*a* on the proximal face is abraded, the edge 62C properly makes a stick and slip movement to prevent the abrasion because of being modified to have a friction coefficient of from 0.27 to 0.4. Further, even after the edge 62*c* of the elastic blade 622 is exposed, good cleanability can be maintained because the edge 62C properly makes a stick and slip movement.

Meanwhile, zonal poor cleaning occurred in Comparative Example 1. This is because the edge friction coefficient is high without impregnating treatment and surface layer, the mobility of the edge is not properly controlled, the edge is turned over, the proximal face was abraded, and a toner locally scraped through the blade, resulting in poor cleaning.

An oscillation noise was made in Comparative Example 2. The elastic blade is not impregnated and has a high friction coefficient. Therefore, the base rubber exposed as the blade was abraded oscillated by friction with the photoreceptor, and the oscillation had an audible frequency, resulting in oscillation noise. Poor cleaning also occurred therein. This is because the oscillation energy of the exposed base rubber partially broke the side edges of the base rubber under the apical and distal face layers, and a toner scraped through there of the blade, resulting in poor cleaning.

Poor cleaning occurred earlier in Comparative Example 3. This is because the friction coefficient between the proximal face layer and the photoreceptor is 0.25 which is so low that the edge does not fully make stick and slip movement. An oscillation noise was also made in Comparative Example 2. This is because the friction coefficient between the distal face layer 623*b* of the blade and the photoreceptor is 0.6 which is so high that the distal face layer 623*b* of the blade oscillates, resulting in oscillation noise. Further, Comparative Example 3 noticeably deteriorated in abrasion resistance, having the abraded width of 70 μm. This is because the proximal face layer 623*a* was abraded earlier. The proximal face layer 623*a* includes an additive lowering the friction coefficient, which probably destabilizes the molecular structure of the surface layer 623*a* and deteriorates the abrasion resistance thereof, resulting in earlier abrasion thereof. In addition, that the edge 62*c* does not fully make stick and slip movement is one of the reason. Further, the proximal face was turned over and abraded in Comparative Example 3. This is because the additive lowering the friction coefficient included in the surface layer 623*a* decreased the rigidity thereof, and which could not prevent the proximal face from turning over and being abraded.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-045377 filed on Mar. 2, 2010, the entire contents of which are hereby incorporated by reference herein.

What is claimed is:

1. A reed-shaped elastic cleaning blade, comprising:

an edge, movable along the surface of a member to be cleaned while contacting the edge to the surface thereof to remove a powder therefrom, a distal face, extending perpendicular to a thickness direction of the blade, defined along one side by the edge of the blade;

a proximal face, extending parallel to the thickness direction of the blade, defined along one side by the edge of the blade; and surface layers having a hardness greater than a hardness of the elastic blade, formed on the distal and proximal faces of the blade, wherein a friction coefficient between the surface layer on the distal face of the blade and the member to be cleaned is lower than that between the surface layer on the proximal face of the blade and the member to be cleaned.

2. The cleaning blade of claim 1, wherein the friction coefficient between the surface layer on the proximal face of the blade and the member to be cleaned is from 0.3 to 0.6, and the friction coefficient between the surface layer on the distal face of the blade and the member to be cleaned is not greater than 0.25.

3. The cleaning blade of claim 1, wherein the edge of the elastic blade is impregnated with a member selected from the group consisting of isocyanate compounds, fluorine-containing compounds, and silicone compounds.

4. The cleaning blade of claim 3, wherein a friction coefficient between the edge of the elastic blade and the member to be cleaned is lower than that between the surface layer on the proximal face of the blade and the member to be cleaned, and higher than that between the surface layer on the distal face of the blade and the member to be cleaned.

5. The cleaning blade of claim 1, wherein the surface layers on the proximal face and the distal face of the blade are formed of an UV-cured resin.

6. The cleaning blade of claim 1, wherein the elastic blade is formed of rubber comprising a urethane group.

7. An image forming apparatus, comprising:

an image bearer configured to bear an image;

a charger configured to charge the surface of the image bearer;

a latent image former configured to form an electrostatic latent image on the surface of the charged image bearer;

an image developer configured to develop the electrostatic latent image formed on the surface of the image bearer to form a toner image thereon;

a transferer configured to transfer the toner image on the surface of the image bearer to a transfer material;

a cleaner comprising the cleaning blade according to claim 1, configured to remove a residual toner adhering to the surface of the image bearer while contacting thereto; and a lubricator configured to apply a lubricant to the surface of the image bearer, to give the image bearer a friction coefficient not greater than 0.2 when the image forming apparatus does not produce images.

8. A process cartridge detachable from image forming apparatus, comprising:

an image bearer configured to bear an image;

a cleaner comprising the cleaning blade according to claim 1, configured to remove a residual toner adhering to the surface of the image bearer while contacting thereto; and a lubricator configured to apply a lubricant to the surface of the image bearer, to give the image bearer a friction coefficient not greater than 0.2 when the image forming apparatus does not produce images.

* * * * *